US005529219A

United States Patent [19]

Ward

[11] Patent Number: 5,529,219

[45] Date of Patent: Jun. 25, 1996

[54] APPARATUS FOR STORING AND DISPENSING LAUNDRY SOAP

[76] Inventor: Lloyd L. Ward, 720 Amity Apt. E, Nampa, Id. 83651

[21] Appl. No.: 536,484

[22] Filed: Sep. 29, 1995

Related U.S. Application Data

[63] Continuation of Ser. No. 198,349, Feb. 18, 1994, abandoned.

[51] Int. Cl.[6] ..... B67D 5/38

[52] U.S. Cl. ..... 222/156; 222/181.1; 222/511; 222/561

[58] Field of Search ..... 222/156, 180, 222/181, 185, 511, 561

[56] References Cited

U.S. PATENT DOCUMENTS

| | | | |
|---|---|---|---|
| 1,219,737 | 3/1917 | Heilig | 222/561 |
| 1,751,535 | 3/1930 | Terborg | 222/561 X |
| 2,479,347 | 8/1949 | Gotham | 222/561 X |
| 2,827,204 | 3/1958 | McCurdy | 222/561 X |
| 2,857,940 | 10/1958 | Lane | 222/185 X |
| 3,132,772 | 5/1964 | Bristow | 222/181 |
| 4,513,885 | 4/1985 | Hogan | 222/95 |
| 4,903,866 | 2/1990 | Loew | 222/180 X |
| 5,139,173 | 8/1992 | Euinger | 222/156 X |

FOREIGN PATENT DOCUMENTS

| | | | |
|---|---|---|---|
| 136656 | 10/1993 | Austria | 222/561 |

*Primary Examiner*—Joseph A. Kaufman

[57] ABSTRACT

Apparatus for storing and dispensing laundry soap comprising a generally box-like container, the container having an open upper end with a lid secured to one edge of the container by a hinge for adding additional particulate material to the container to be stored and dispensed, the lower end of the container being formed with a lower wall sloping forwardly and downwardly from the rear end of the container to the forward end of the container; an opening formed in the front face adjacent to its lower end for dispensing the stored particulate materials therefrom; a vertically disposed door reciprocal from a closed lower orientation sealing the opening and a raised opened orientation for allowing contents within the container to be dispensed therefrom; guide flanges extending forwardly through the side walls of the container to constrain the door for linear reciprocal movement in a vertical plane; a bracket secured to the front face of the container with a horizontal extension and an aperture located above the door with a rod secured at its lower end to the upper edge of the door and extending upwardly in slidable relationship through the aperture in the bracket with a coil spring secured around the rod to urge the door to its lower closed orientation; and a manual door lift member secured to the exterior surface of the door to allow lifting the door by the user to allow the dispensing of particulate material therefrom.

1 Claim, 3 Drawing Sheets

FIG. 1
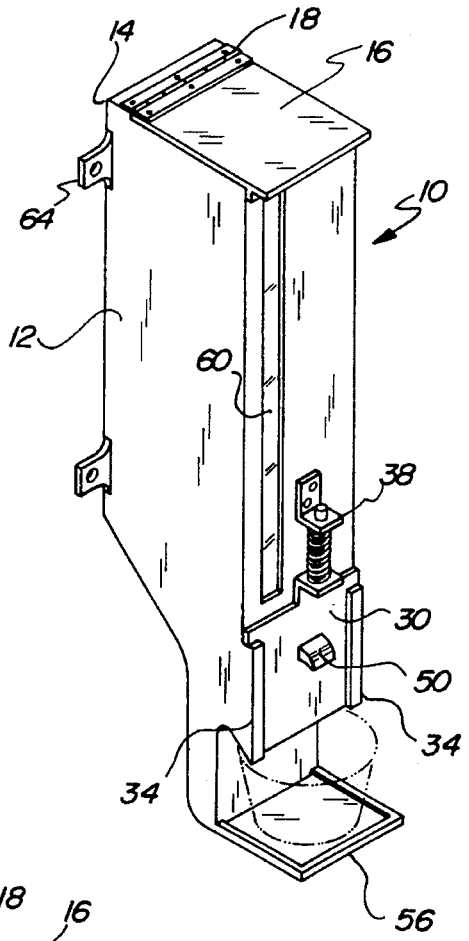
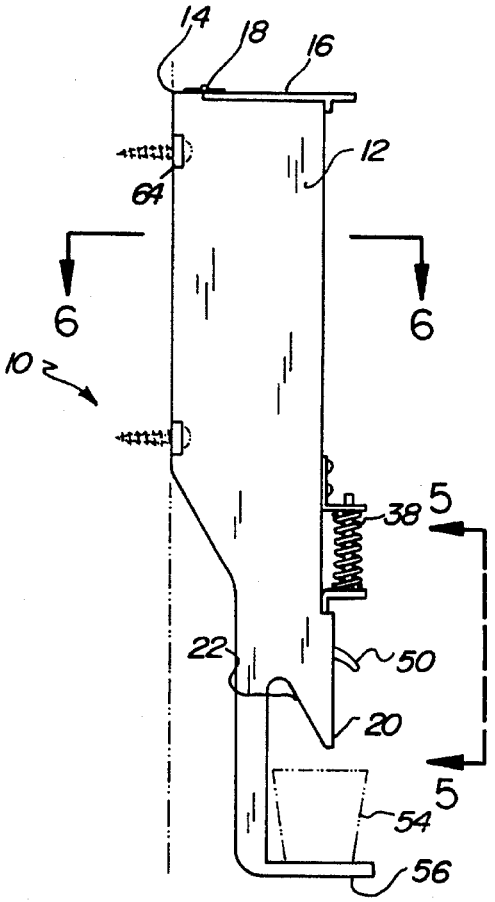
FIG. 2

FIG. 3
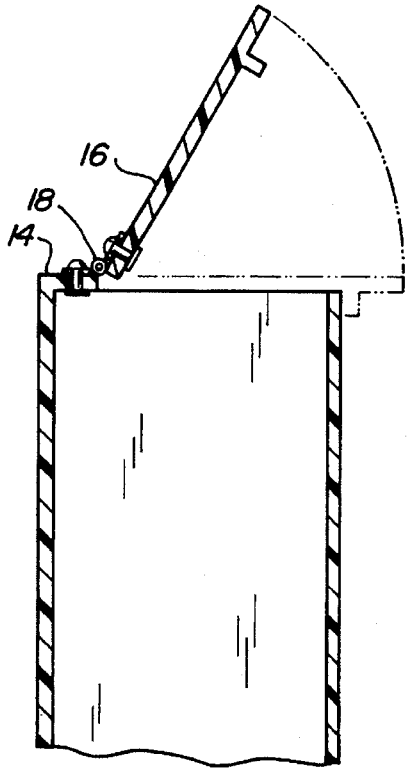
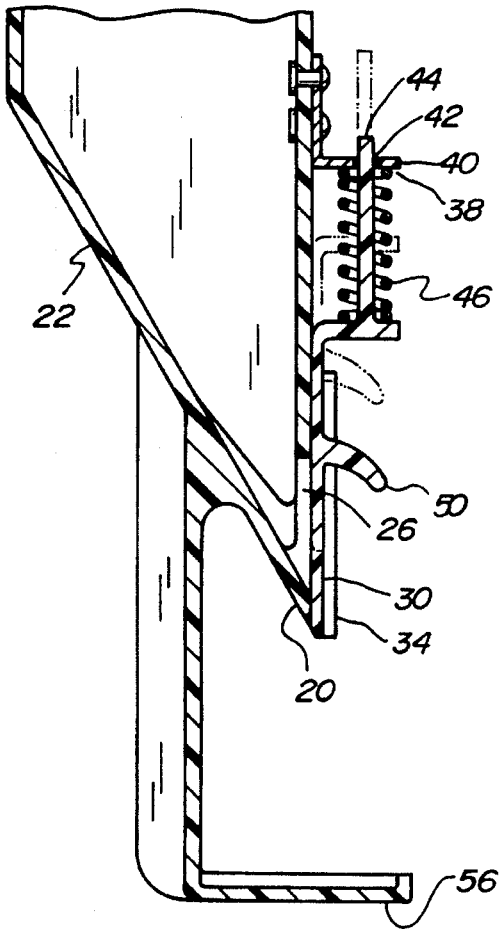
FIG. 4

APPARATUS FOR STORING AND DISPENSING LAUNDRY SOAP

This is a continuation of copending application(s) Ser. No. 08,198,349 filed on Feb. 18, 1994, now abandoned.

BACKGROUND OF THE INVENTION

1. Field of the Invention

The present invention relates to apparatuses for storing and dispensing laundry soap and more particularly pertains to storing laundry soap and dispensing it in predetermined quantities in an accurate, convenient and tidy manner.

2. Description of the Prior Art

The use of dispensers for particulate materials is known in the prior art. More specifically, dispensers for particulate materials heretofore devised and utilized for the purpose of dispensing such materials from a container for subsequent use are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 3,696,970 a dispensing device adapted for use with an appliance such as a washing machine for dispensing from separate compartments at least two different types of laundry agents such as a detergent, bleach, fabric conditioner, rinsing additive or the like at distinct periods during the operation of the washing machine.

U.S. Pat. No. 4,915,267 discloses a dispensing storage container comprising a somewhat spherical housing forming a storage compartment for a supply of laundry treatment liquid and having an inlet/outlet portion, which may also be a removable cover portion.

U.S. Pat. No. 5,154,212 discloses a container for dispensing a laundry agent which rests on a shelf adjacent the clothes washer, with a portion of the container extending over the edge of the shelf, having a measuring device removably positioned on the portion.

U.S. Pat. Des. No. 248,103 discloses a design for a powder detergent dispenser.

In this respect, the apparatus for storing and dispensing laundry soap according to the present invention substantially departs from the conventional concepts and designs of the prior art, and in doing so provides an apparatus primarily developed for the purpose of storing laundry soap and dispensing it in predetermined quantities in an accurate, convenient and tidy manner.

Therefore, it can be appreciated that there exists a continuing need for new and improved apparatus for storing and dispensing laundry soap which can be used for storing laundry soap and dispensing it in predetermined quantities in an accurate, convenient and tidy manner. In this regard, the present invention substantially fulfills this need.

SUMMARY OF THE INVENTION

In view of the foregoing disadvantages inherent in the known types of dispensers for particulate materials now present in the prior art, the present invention provides an improved apparatus for storing and dispensing laundry soap. As such, the general purpose of the present invention, which will be described subsequently in greater detail, is to provide a new and improved apparatus for storing and dispensing laundry soap and a method which has all the advantages of the prior art and none of the disadvantages.

To attain this, the present invention essentially comprises a new and improved apparatus for storing and dispensing laundry soap comprising, in combination a generally box-like container, the container having an open upper end with a lid secured to one edge of the container by a hinge for adding additional particulate material to the container to be stored and dispensed, the lower end of the container being formed with a lower wall sloping forwardly and downwardly from the rear end of the container to the forward end of the container; an opening formed in the front face adjacent to its lower end for dispensing the stored particulate materials therefrom; a vertically disposed door reciprocal from a closed lower orientation sealing the opening and a raised opened orientation for allowing contents within the container to be dispensed therefrom; guide flanges extending forwardly through the side walls of the container to constrain the door for linear reciprocal movement in a vertical plane; a bracket secured to the front face of the container with a horizontal extension and an aperture located above the door with a rod secured at its lower end to the upper edge of the door and extending upwardly in slidable relationship through the aperture in the bracket with a coil spring secured around the rod to urge the door to its lower closed orientation; a manual door lift member secured to the exterior surface of the door to allow lifting the door by the user to allow the dispensing of particulate material therefrom; a measuring cup positionable beneath the chamber on the ledge for receiving the contents of the container dispensed through the opening; a transparent window formed in the front face along the majority of the length thereof from adjacent to the door to adjacent to the lid for determining the quantity of material remaining to be dispensed from within the container; and a plurality of wall mounting brackets secured with respect to the rear face of the container for mounting the container on a wall.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved apparatus for storing and dispensing laundry soap which have all the advantages of the prior art dispensers for particulate materials and none of the disadvantages.

It is another object of the present invention to provide a new and improved apparatus for storing and dispensing laundry soap which may be easily and efficiently manufactured and marketed.

It is further object of the present invention to provide new and improved apparatuses for storing and dispensing laundry soap which are of durable and reliable constructions.

An even further object of the present invention is to provide new and improved apparatus for storing and dispensing laundry soap which are of a low cost of manufacture with regard to both materials and labor, and which accordingly are then of low prices of sale to the consuming public, thereby making such apparatus for storing and dispensing laundry soap economically available to the buying public.

Still yet another object of the present invention is to provide new and improved apparatuses for storing and dispensing laundry soap which provide in the apparatuses and methods of the prior art some of the advantages thereof, while simultaneously overcoming some of the disadvantages normally associated therewith.

Still another object of the present invention is to store laundry soap and dispense it in predetermined quantities in an accurate, tidy and convenient manner.

Lastly, it is an object of the present invention to provide new and improved apparatus for storing and dispensing laundry soap comprising a generally box-like container, the container having an open upper end with a lid secured to one edge of the container by a hinge for adding additional particulate material to the container to be stored and dispensed, the lower end of the container being formed with a lower wall sloping forwardly and downwardly from the rear end of the container to the forward end of the container; an opening formed in the front face adjacent to its lower end for dispensing the stored particulate materials therefrom; a vertically disposed door reciprocal from a closed lower orientation sealing the opening and a raised opened orientation for allowing contents within the container to be dispensed therefrom; guide flanges extending forwardly through the side walls of the container to constrain the door for linear reciprocal movement in a vertical plane; a bracket secured to the front face of the container with a horizontal extension and an aperture located above the door with a rod secured at its lower end to the upper edge of the door and extending upwardly in slidable relationship through the aperture in the bracket with a coil spring secured around the rod to urge the door to its lower closed orientation; and a manual door lift member secured to the exterior surface of the door to allow lifting the door by the user to allow the dispensing of particulate material therefrom.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the new and improved apparatus for storing and dispensing laundry soap constructed in accordance with the principles of the present invention.

FIG. 2 is a side elevational view of the device shown in FIG. 1.

FIG. 3 is a cross-sectional view of the upper portion of the device of FIGS. 1 and 2.

FIG. 4 is a cross-sectional view of the lower portion of the device shown in FIGS. 1 and 2.

The same reference numerals refer to the same parts through the various FIGS.

DESCRIPTION OF THE PREFERRED EMBODIMENT

Figure 5:
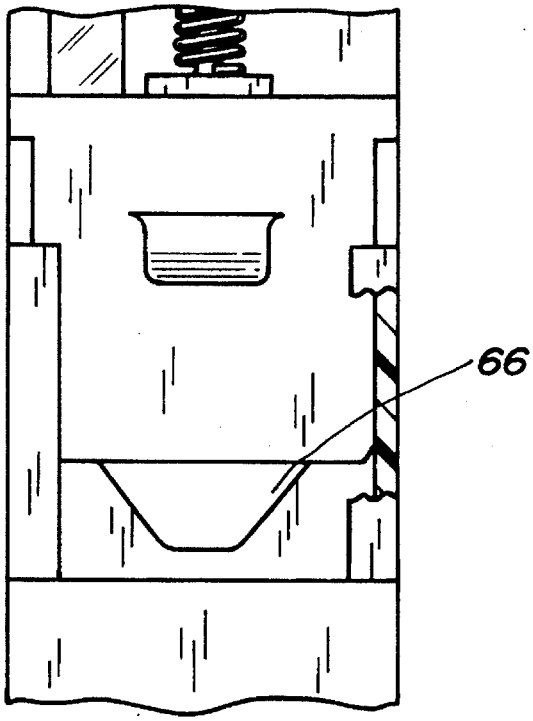
FIG. 5 a front elevational view of the lower portion taken along lines 5—5 of FIG. 2.

With reference now to the drawings, and in particular to FIG. 1 thereof, the preferred embodiment of the new and improved apparatus for storing and dispensing laundry soap embodying the principles and concepts of the present invention and generally designated by the reference numeral 10 will be described.

The present invention, a new and improved apparatus for storing and dispensing laundry soap, is a system 10 comprised of a plurality of components. The components, in their broadest context, include a container, an opening in the container, a door in the opening, guide flanges for the door, a bracket to hold the door closed and a manual door lift. The components are individually configured and correlated with respect to each other so as to attain the intended objectives.

More specifically, the central component of the system is a generally box-like container 12. The container 12 has an opened upper end 14 with a lid 16. The lid is secured to one edge of the container by a hinge 18. This is to normally seal the container but to allow opening the door for the adding of additional particulate material, soap powder to the container to be stored and eventually dispensed. The lower end 20 of the container is formed with a lower wall 22 sloping forwardly and downwardly from the rear end of the container to the forward end of the container.

Formed within the front face of the container adjacent to its lower end is an opening 26. It is through this opening that the stored particulate material, the soap powder, is dispensed.

Located within the opening is a door 30. The door 30 is disposed in a vertical plane and it is reciprocal from a closed lower orientation. At such orientation, the opening is sealed to preclude dispensing of particulate material. The door is also adapted to be raised to an opened orientation. In such orientation, the particulate contents are allowed to fall by gravity from within the container to exterior thereof for being dispensed and used.

Also located with respect to the opening are a pair of parallel guide flanges 34. Such guide flanges extend forwardly through the side walls of the container to contact and constrain the lateral side edges of the door. Such constraint of the door is to limit the movement of the door for reciprocal movement linearally in a vertical plane, the plane in which the door is located.

Greater utility of the system is provided through a bracket 38. The bracket is secured to the front face of the container. It has a horizontal extension 40 and an aperture 42 located above the door. A rod 44 is secured at its lower end to the upper edge of the door and extends upwardly in slidable relationship through the aperture in the bracket. As can clearly be seen in FIGS. 1, 2 and 4, the upper edge of the door also comprises a bracket having a horizontal extension, the horizontal extension receiving the lower end of the rod 44. The horizontal extension on the door is spaced from and is parallel to the horizontal extension 40 on the front face. A coil spring 46 is secured around the rod to urge the door to its lower closed orientation. This insures that particulate material will be dispensed only when it is intended to be dispensed by a user.

The last major component of the primary embodiment is a manual door lift 50. The manual door lift is a member secured to the exterior surface of the door. It functions to allow a user to lift the door for exposing the particulate contents within the container to be dispensed through the opening. Such door lift simply makes moving of the door more convenient to the user.

Adapted to be used in association with the container of the present invention is a measuring cup 54. Such measuring cup is positionable beneath the chamber adjacent to the opening and door. It is adapted to have its upper end immediately beneath the opening. It is of a size whereby when it is placed on a ledge 56 therebeneath and extending forwardly from a rearward portion of the container, it will receive the contents of the container dispensed through the opening. Such cup is conventional and may be constructed with scribe marks to designate the quantity of soap dispensed and received within the container.

Additional utility is provided to the container by including a transparent window 60. Such window is preferably formed in the front face of the container for easy viewing by the user. It extends along the majority of the length of the front face from a lower portion adjacent to the door and immediately thereabove to an elevated location adjacent to the lid and immediately therebeneath. Such transparent window functions for determining the quantity of particulate material remaining to be dispensed from within the container. Such determination may also be made of the material used over the prior period of time.

Lastly, a plurality of wall mounting brackets 64 are secured with respect to the rear face of the container. Such brackets allow for mounting the container on a wall at any convenient height or position for use by the user in association with doing laundry.

Figure 6:
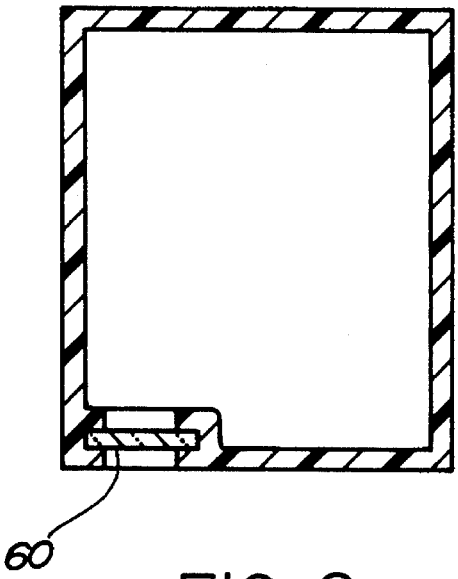
FIG. 6 is a cross-sectional view taken along lines 6—6 of FIG. 2.

One optional feature of the invention, an alternate embodiment, is shown in FIGS. 5 and 6. In such embodiment, the opening 66 is of a modified design. Such modified design features the tapering of the side walls thereof. In this manner, the gradual opening of the door will allow smaller amounts and, consequently a more accurate dispensing of the particulate material as caused by the restricted lateral opening effected by the curved edges.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An apparatus for storing and dispensing laundry soap comprising, in combination:

a generally box-like container, the container having an open upper end with a lid secured to one edge of the container by a hinge for adding additional particulate material to the container to be stored and dispensed, the lower end of the container being formed with a lower wall sloping forwardly and downwardly from the rear end of the container to the forward end of the container;

an opening formed in the front face adjacent to its lower end for dispensing the stored particulate material therefrom;

a vertically disposed door reciprocal from a closed lower orientation sealing the opening and a raised opened orientation for allowing contents within the container to be dispensed therefrom;

guide flanges extending forwardly through the side walls of the container to constrain the door for linear reciprocal movement in a vertical plane;

the container and including a first horizontal extension projecting from the front face of the container, the first horizontal extension including an aperture directed therethrough; a second bracket secured to the door and including a second horizontal extension projecting from the door and into a substantially spaced and parallel orientation relative to the first horizontal extension of the first bracket; a rod fixedly secured to the second horizontal extension of the second bracket and projecting upwardly therefrom through the aperture directed through the first horizontal extension; and a spring interposed between the first horizontal extension and the second horizontal extension which biases the first horizontal extension and the second horizontal extension apart to position the door into the lower closed orientation;

a manual door lift member secured to the exterior surface of the door to allow lifting the door by the user to allow the dispensing of particulate material therefrom;

a ledge fixedly secured to a lower region of the container and having a rearward edge secured to the container beneath a central extent thereof and a forward edge forward of the container;

a measuring cup positionable beneath the container on the ledge for receiving the contents of the container dispensed through the opening;

a transparent window formed in the front face along the majority of the length thereof from adjacent to the door to adjacent to the lid for determining the quantity of material remaining to be dispensed from within the container; and a plurality of wall mounting brackets secured with respect to the rear face of the container for mounting the container on a wall.

* * * * *